US006033249A

United States Patent [19]

Holzer

[11] Patent Number: 6,033,249

[45] Date of Patent: Mar. 7, 2000

[54] SAFETY SOCKET/MOUNTING SYSTEM FOR FILAMENT AND GAS-DISCHARGE LAMPS

[76] Inventor: Walter Holzer, Drosteweg 19, D-88709, Meersburg, Germany

[21] Appl. No.: 08/985,348

[22] Filed: Dec. 4, 1997

[30] Foreign Application Priority Data

Feb. 20, 1997 [DE] Germany ..... 197 06 905

[51] Int. Cl.[7] ..... H01R 13/627

[52] U.S. Cl. ..... 439/356

[58] Field of Search ..... 439/350–357, 439/619, 699.1, 699.2

[56] References Cited

U.S. PATENT DOCUMENTS

| | | | |
|---|---|---|---|
| 4,667,270 | 5/1987 | Yagi | 439/356 X |
| 5,669,703 | 9/1997 | Wheeler et al. | 439/356 X |
| 5,795,192 | 8/1998 | Ullrich | 439/619 |
| 5,800,183 | 9/1998 | Paul et al. | 439/699.2 |

*Primary Examiner*—Khiem Nguyen

*Attorney, Agent, or Firm*—Marshall, O'Toole, Gerstein, Murray & Borun

[57] ABSTRACT

A new safe-to-touch plug-in socket system for light bulbs is described to replace the previous systems with Edison or bayonet sockets, which are not safe to touch.

10 Claims, 1 Drawing Sheet

SAFETY SOCKET/MOUNTING SYSTEM FOR FILAMENT AND GAS-DISCHARGE LAMPS

BACKGROUND OF THE INVENTION

Edison and bayonet light bulb mountings are known to pose potential shock hazards, but have been used worldwide for many decades and continue to be used in huge numbers. These mountings represent the only exception in the relevant safety specifications, since, in spite of many years of effort, no useful alternative existed.

The drafts for the standards, which have been available internationally since 1975, place strict requirements for a new socket/mounting system.

The task of the invention is to describe a new socket and a corresponding safe-to-touch mounting which presents no danger, either when the lamp is taken out or during insertion. For such a new socket/mounting system, all other requirements of the standard drafts must also be taken into consideration.

The solution according to the invention to solve this task consists in designing the contact system as a safe-to-touch, pluggable pin contact system, which is arranged at the axial end surface of the socket and has at least two axial pins, while the socket is provided with snap-in profiles, so that the diameter of the socket and of the contact system is smaller than the diameter of the Edison or bayonet system to be replaced.

Only with the arrangement of the contact pins on the front face of the socket according to the invention can the diameter of the new system be kept so small that, with regard to size, the previous dimensions of the Edison or bayonet mountings can be achieved.

It is especially favorable to make the socket have a circular cross-section with two circular segments, which permits one to bring the snap-in profiles within the circular shape.

The snap-in profiles on the socket are expediently designed as a rigid profile, which secures seating of the lamp in the mounting, together with the corresponding spring-loaded catches.

A cost-saving and reliable solution consists in making both catches from nonmetallic material and to mold them into the insulating part. As a result of this, in spite of the small dimensions, the prescribed safety distances can be maintained.

In the new socket/mounting system, coding can also be provided which will prevent inadvertent use of lamps in mountings which require different operating conditions. This can involve, for example, different operating voltages, impermissible power in the lamp in a light fixture or other operating conditions.

The contact system according to the invention also facilitates the insertion and removal of lamps. In order to make this process even safer, it is furthermore proposed to have a locking incline in the mountings at an angle of 45° or less, which makes a better sensation of snapping-in of the socket in the mounting. Such a locking incline provides a sufficient axial force component to hold the socket in the mounting. This function can be further improved by providing a limit to the plug-in stroke, which limits the plug-in stroke in the region of the locking incline. As a result of this, the axial force component, which is produced by the locking incline, is retained even when the lamp is fully plugged in, and ensures nonpositive and positive locking of the lamp in the mounting.

The plugging-in of the lamp is facilitated according to the invention by the fact that a plug-in incline of 30° or less is present.

In order to fulfill the requirements of touch safety but also to protect the spring-loaded catch in the mounting, it is furthermore recommended to provide a protecting collar around the plug-in openings for the pins of the socket in the mounting, which also surrounds the spring-loaded catches in the mounting. Positive locking guides facilitate the finding of the holes for the pins within the protective collar.

BRIEF DESCRIPTION OF THE DRAWINGS

FIGS. 1 to 6 show schematically some practical examples of a socket/mounting system according to the invention, but these representations should in no way be regarded as a limitation because, naturally, numerous variations of such mountings are necessary to satisfy the requirements of the lighting industry and of its designers.

FIGS. 1, 1*a* and 1*b* show a filament lamp with a pin socket and the corresponding mounting and a top view of the socket.

FIGS. 2, 2*a* and 2*b* show a coiled fluorescent lamp also with a socket and the axial view of a four-pin socket according to the invention.

FIGS. 3 and 3*a* show the cooperation of a socket according to the invention and the corresponding mounting with plastic catch.

FIG. 4 is a view of a mounting in the plug-in direction of the lamp.

FIG. 5 is a corresponding view of the lamp socket with different codings.

FIG. 6 serves to describe the catch according to the invention.

DETAILED DESCRIPTION OF A PREFERRED EMBODIMENT

Figures 1, 1A, 1B, 2, 2A, 2B, 3, 3A, 4, 5, 6:
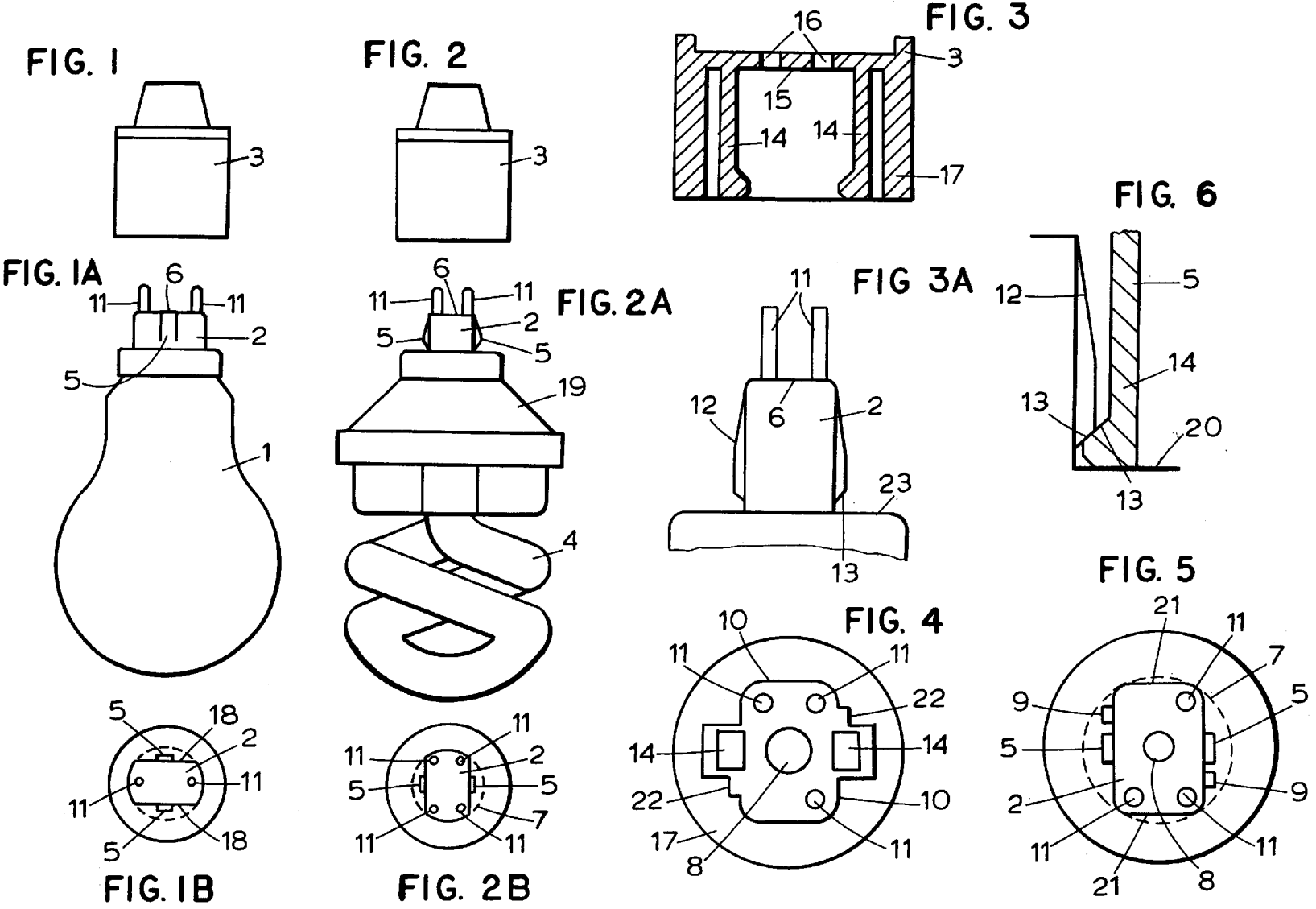

An accurate description of the idea of the invention is given below with the aid of the figures:

FIGS. 1*a* and 2*a* show the enormous difference of the new socket systems in comparison with the state of the art Edison screw-in mountings. In addition to the advantage of providing a structure which can be safely touched, the simple insertion and pulling out of the lamps from the mounting are noteworthy advantages. The sockets (2) carry two or four pins (11) in the axial front face (6) according to safety requirements.

Snap-in profiles (5) are located on the side of the socket (2) and, as shown in FIG. 3, when inserted into the mounting (3), they correspond to the spring-loaded snap-in profiles (5). The compact fluorescent lamp with a light spiral (4) shown in FIG. 2*a* is a typical example of the idea of the invention.

In the case of compact fluorescent lamps, the simplification and thus the savings is especially great, since the socket (2) can be molded directly on the plastic housing (19) and any other mounting which was necessary so far in the case of the Edison mountings can be omitted. Only two pins (11) are inserted into the housing (19).

FIGS. 1*b* and 2*b* show clearly the advantage of the idea of the invention, to bring both the pins (11) and the snap-in profiles (5) within a circular form (7). The snap-in profiles (5) lie in circular section (18) in order to bring these parts, which are so important to the function, also within the circular shape (7). Naturally, it is also possible to design the other edges (21) as circular sections, so that the socket will have a rectangular shape, but it is recommended to have the corners rounded.

Moreover, FIG. 5 shows that, within the circular form (7), codes (9) in the form of axial strips can be included, without going beyond the circular form (7). FIGS. 4 and 5 show other coding possibilities, for example, a central coding (8) as a round pin in socket FIG. 5 comprising a correspondingly larger bore in the mounting. By different pin arrangements in the pins of the four possibilities, lamps can be coded in the future for different voltage or for different functions.

FIGS. 3 and 3*a* show the important cooperation of the snap-in profiles (5) on socket (2), with the spring-loaded catches (14) in the mounting (3).

According to the invention, the snap-in profiles (5) are designed in such a way that the plug-in inclines (12) are very flat, possibly at an angle of 30° or smaller if it can be arranged. This facilitates the insertion of the socket (2) into the mounting (3). On the other hand, the locking inclines (13) both on the snap-in profiles (5) as well as on the spring-loaded catches (14) are provided at an angle of 45° or less, if possible, in order for the axial component of the forces produced to be sufficient when the catches (14) enter the snap-in profile (5).

An especially favorable securing of the socket (5) in the mounting (3) is achieved by the fact that, before complete locking of the locking incline, a stop (20) is arranged which ends the insertion movement produced by the locking inclines (13) before the spring-loaded catch (14) has entered the snap-in profile (5) completely. As a result, there will be a residual component of the axial force which secures safe seating of the socket (2) in the mounting (3). For example, the shoulder surface (23) of socket (2) or the bottom (15) of the mounting (3) can be used as stop, which also has a hole (16) for the pins (11) .

According to the invention, in the preferred embodiment both of the snap-in profiles (5) as well as of the spring-loaded catches (14), are made of nonmetallic material. Plastic catches have the advantage that they do not corrode and that their shape can be more freely designed than that of metallic parts that have to bend. This can also be seen clearly in FIG. 3*a* and FIG. 6.

Furthermore, according to the invention, it is recommended to surround both the pins (11) as well as the spring-loaded catches (14) with a protective collar (17) to protect them, on the one hand, to avoid touching of the pins (11) when the pins are inserted, but also in order to protect the catches against damage. Moreover, such a protective collar (17) provides the possibility to install nonpositive guides (10) and recesses (22) as a counter profile for the codes (9) of the sockets (2).

The individual proposals taken in combination represent an enormous progressive improvement of the mountings which have not been safe to touch so far and, moreover, expand further essential developments in this area, for example, by the possibility of coding and by using a larger number of pins in comparison to the previous mountings.

What is claimed:

1. A socket and mounting system for electric lamps comprising:

an electrically-activated lamp comprising a light-emitting bulb portion and a profiled socket portion;

said lamp socket portion having snap-in profiles for cooperating with springs in a socket, and a pair of axial pins extending from said socket portion for contacting a source of electrical power in a mounting;

said mounting comprising:

recessed electrical contacts in a base of the mounting;

the profile of said mounting corresponding to the profile of said lamp socket portion for guiding said axial pins into said recessed electrical contacts;

a spring-loaded catch on the mounting adapted to cooperate with said snap-in profiles to hold said lamp socket portion in said mounting;

a protective collar extending upwardly from the base of the mounting, the open end of the protective collar surrounding said spring-loaded catch; and said mounting having a diameter which is smaller than the diameter of a conventional Edison lamp mounting system.

2. The socket and mounting system according to claim 1, characterized by the fact that the socket portion has a circular cross-section and that the snap-in profiles are arranged in two circular segments on said socket portion.

3. The socket and mounting system according to claim 1, characterized by the fact that both the snap-in profiles on the socket portion as well as the catch in the spring-loaded mounting are made of nonmetallic material.

4. The socket and mounting system according to claim 1, characterized by the fact that at least one of the catches on the mounting is provided with a locking incline of 45 degree angle or less, in order to achieve a clearly perceivable snapping-in of the socket portion into the mounting.

5. The socket and mounting system according to claim 1, characterized by the fact that at least one of the catches on the socket portion is provided with a plug-in incline of 30° or less in order to make insertion of the socket portion in the mounting possible.

6. The socket and mounting system according to claim 1, characterized by the fact that positive locking guides are present on the protective collar to facilitate the insertion of the socket portion into the mounting.

7. The socket and mounting system of claim 1 wherein said spring-loaded catch is manufactured from a plastic material.

8. The socket and mounting system of claim 1 wherein the spring-loaded catch extends vertically upward from the base of the mounting.

9. The socket and mounting system of claims 7 or 8 wherein said spring-loaded catch is integral with said mounting.

10. The socket and mounting system of claim 1 wherein positive locking guides are present on the protective collar to facilitate insertion of the socket portion into the mounting.

* * * * *